US006723265B1

(12) United States Patent
Osaka et al.

(10) Patent No.: US 6,723,265 B1
(45) Date of Patent: Apr. 20, 2004

(54) METHOD FOR PRODUCING POLYESTER-BASED COMBINED FILAMENT YARN

(75) Inventors: Hiroyuki Osaka, Ehime (JP); Satoshi Nagamune, Ehime (JP); Kenji Iwashita, Ehime (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/889,454

(22) PCT Filed: Jan. 18, 2000

(86) PCT No.: PCT/JP00/00197

§ 371 (c)(1),
(2), (4) Date: Jul. 17, 2001

(87) PCT Pub. No.: WO00/43581

PCT Pub. Date: Jul. 27, 2000

(30) Foreign Application Priority Data

Jan. 25, 1999 (JP) ..... 11-15750

(51) Int. Cl.[7] ..... D01D 5/088; D01D 10/02; D01F 6/62; D02G 1/18; D02G 3/02

(52) U.S. Cl. ..... 264/103; 57/287; 264/210.5; 264/211.12; 264/211.14; 264/211.15; 264/211.17

(58) Field of Search ..... 264/103, 210.5, 264/210.8, 211.12, 211.14, 211.15, 211.17, 235.6; 57/287

(56) References Cited

U.S. PATENT DOCUMENTS 4,153,660 A 5/1979 Reese

FOREIGN PATENT DOCUMENTS

| | | | |
|---|---|---|---|
| JP | 54-082423 | A | 6/1979 |
| JP | 58-098418 | A | 6/1983 |
| JP | 58-191211 | A | 11/1983 |
| JP | 60-126316 | A | 7/1985 |
| JP | 04-194010 | A | 7/1992 |
| JP | 7-243144 | A | 9/1995 |
| JP | 08-209442 | A | 8/1996 |
| JP | 09-095816 | A | 4/1997 |
| JP | 10-331031 | A | 12/1998 |
| JP | 2000-54239 | A | 2/2000 |

OTHER PUBLICATIONS

English Language Written Opinion and International Preliminary Examination Report (Apr. 25, 2001).
CPCH0162105P, Patent Office of the People's Republic of China, First Office Action (Aug. 9, 2002).

*Primary Examiner*—Leo B. Tentoni
(74) *Attorney, Agent, or Firm*—Rader, Fishman & Grauer PLLC

(57) ABSTRACT

A polymer of a kind different from a polyester in an amount within the range of 0.3 to 5.0% by weight based on the polyester is added to the polyester, and the resulting composition is melt-extruded from the same pack. The extruded filament group including polyester multi-filaments is cooled once to the glass transition temperature or below, and the filament group is subsequently divided into two groups. One of the filament groups in an opened state is subjected to non-contact heat treatment at an atmospheric temperature of 120° C. or above; however, the other filament group is kept in a state without being subjected to the heat treatment. The respective filament groups are then simultaneously taken off at a speed of 2500 m/min or above and subjected to doubling and mixing of the filaments.

2 Claims, 1 Drawing Sheet

METHOD FOR PRODUCING POLYESTER-BASED COMBINED FILAMENT YARN

TECHNICAL FIELD

This invention relates to a method for producing polyester-based combined filament yarn and more particularly it relates to a method for producing polyester-based combined filament yarn by which the polyester combined filament yarn is stably produced with good productivity by heat-treating plural groups of extruded polyester multi-filament yarns under different conditions and then doubling and mixing the filaments.

BACKGROUND ART

It is well-known that polyester fibers assuming high bulkiness by carrying out heat treatment are obtained by a method for mutually mixing polyester fibers having a difference in heat shrinkage percentage. That is, the method is to more greatly shrink one of polyester fibers having a higher shrinkage percentage and thereby project the other polyester fibers having a lower shrinkage percentage and impart bulkiness thereto during heat treatment.

Furthermore, the fineness of the single filaments of the highly shrinkable fibers is increased and the fineness of the single filaments of the other low shrinkable fibers is decreased to provide a combined filament yarn, which is then converted into a woven or a knitted fabric and heat-treated to afford a woven or a knitted fabric having a soft surface touch and a handle with stiffness.

Many methods for providing a difference among plural filaments and mixing the filament groups have been adopted in order to afford the polyester combined filament yarn having the difference in heat shrinkage percentage.

For example, JP-A 54-82423 (1979) (hereinafter, JP-A means "Japanese Unexamined Patent Application") describes a production method of a combined filament yarn comprising quenching a multi-filament yarn melt-extruded from the same spinneret, then dividing the multi-filament yarn into two filament bundles, applying a spinning oil consisting essentially of water to either one of the filament bundles and applying a spinning oil having a higher boiling point than that of water to the other filament bundle. According to the method, both the filament bundles are drawn while separately carrying out heat treatment of both the filament bundles under the same conditions subsequently to the process and the filaments are then mixed. Thereby, the combined filament yarn obtained by the method exhibits a difference in shrinkage characteristics by a difference in thermal behavior of the spinning oils applied to the respective filament bindles when drawn while being heat-treated.

However, there are problems that the difference in shrinkage percentage among filament bundles cannot sufficiently be increased by the method for imparting the difference in shrinkage characteristics (the difference in boiling water shrinkage percentage) among the filament bundles divided by utilizing a difference in boiling point of the spinning oils applied to the filament bundles during the spinning. As a result, the difference in shrinkage percentage among the filaments of the resultant combined filament yarn is small, and the bulkiness is poor. A satisfactory handle is not obtained.

In addition, JP-A 58-191211 (1983) describes a production method of a combined filament yarn by melt extruding two multi-filament yarns from the same spinning pack, providing a difference between collecting positions of both the yarns, taking off the yarns at a spinning takeoff speed of 4500 m/min or above, producing a difference in air resistance force during the takeoff, mixing the filaments, winding the resulting filament yarn and thereby producing a difference between the two yarns in shrinkage percentage. Furthermore, JP-A 60-126316 (1985) describes a production method of a combined filament yarn by melt extruding two or more multi-filament yarns from the same spinning pack, taking off the multi-filament yarns once so as to produce a difference in spinning speed of either one of the filament yarns from the spinning speed of the other filament yarn, then mixing the filament yarn at a higher spinning speed with the filament yarn at a lower spinning speed, taking off the resulting filament yarn, winding the yarn and producing a difference in shrinkage. The difference in shrinkage percentage of the yarns is obtained; however, neither a thermal stress required to exhibit a sufficient fullness in a woven fabric is produced nor a favorable handle is obtained by the methods.

Further, JP-A 7-243144 (1995) describes a method for production by applying water to one filament group in plural melt-extruded filament groups, keeping the other filament group in an uncollected state without applying water thereto, simultaneously passing the filament groups through heat-treating cylinders respectively set at 150° C. or above, taking off the filament groups at a speed of 3000 to 5500 m/min, doubling and mixing the filaments.

In this method, it was surely confirmed that a high shrinkage percentage to some extent was maintained because the filament groups to which water was applied did not receive so much effects of heat in the heat-treating cylinder due to different collecting positions and application of water in advance and that a high elongation was obtained because the filament group was kept in a state without being subjected to drawing and high bulkiness was exhibited by heat treatment. There were, however, problems that a combined filament yarn which was hard to obtain a uniform dyeing finish and had a difference in light and shade close to a state of the colored yarn in so-called sprinkling (unevenness of about 1 cm or above in the yarn longitudinal direction) was merely obtained.

In addition, JP-A 8-209442 (1996) describes a combined filament yarn comprising two filament groups different in heat shrinkage percentage of highly shrinkable filaments and low shrinkable filaments in which the low shrinkable filaments are composed of polyethylene terephthalate and the highly shrinkable filaments are composed of a copolymerized polyethylene terephthalate prepared by copolymerizing a specific amount of three kinds of copolymerization components consisting essentially of isophthalic acid and two kinds of hydroxyethoxyphenols and the difference in heat shrinkage percentage was within the range of 5 to 25%. Although a sufficient difference in heat shrinkage percentage was surely obtained by copolymerizing the third component, it was difficult to say that the resulting polyester combined filament yarn was an inexpensive combined filament yarn excellent in productivity and it was unfavorable because the ability of the highly shrinkable filaments themselves was deteriorated even in aspects of the copolymerization of the third component consisting essentially of the isophthalic acid.

Further, JP-A 58-98418 (1983) describes a textured yarn in which high bulkiness was exhibited by adding another kind of polymer to a base polymer without copolymerization of the third component as the highly shrinkable filaments. In this case, the difference in yarn physical properties after false twisting by a difference from the base polymer was small, and the combined filament yarn was insufficient in softness or the like though sufficient for bulkiness.

As another method, JP-A 4-194010 (1992) and JP-A 9-95816 (1997) describe methods for producing combined filament yarns having a difference in elongation and excellent even in color developing properties by changing the discharge hole diameter of a spinneret, providing a difference in draft and producing a difference between a high draft side and a low draft side in spinneret surface temperature. There are, however, problems that the production cost of the spinneret used was extremely increased in order to exhibit the difference in elongation by the difference in draft.

Market needs for textile products have recently been changed from demands for uniform and homogeneous ones to demands for multikind and diverse products according to an aim of consumers at a higher class and further changed from the small kind mass-production to the production of products having added values of diversified small-quantity production. Therefore, it has been desired to improve the production technique for improving the productivity, suppressing a factor to a cost increase and producing the products having added values while responding to demands for quality and quantity of brands having added values.

DISCLOSURE OF THE INVENTION

It is an object of the present invention to provide a method by which a combined filament yarn, having a great difference in heat shrinkage percentage among respective filaments constituting the combined filament yarn and therefore being excellent in handle, can be produced in a simple process at a low cost when polyester yarns are doubled and converted into the combined filament yarn.

According to the research of the present inventors et al., it has been found that the object can be achieved by a production method of the polyester combined filament yarn by adding a polymer different from a base polymer comprising a polyester component in an amount within the range of 0.3 to 5.0% by weight to the base polymer, melt extruding the resulting composition from the same pack, cooling the extruded filament group comprising polyester multifilaments once to the glass transition temperature or below, then dividing the filament group into two groups, subjecting one filament group in an opened state to non-contact heat treatment at an atmospheric temperature of 120° C. or above, keeping the other filament group in a state without being subjected to the heat treatment and subsequently simultaneously taking off the respective filament groups at a speed of 2500 m/min or above and doubling and mixing the filament groups.

Furthermore, it has been found that a combined filament yarn more improved in bulkiness and good in handle is obtained by regulating the discharge hole diameter of the filaments without being subjected to the heat treatment to 1.5 times or above the discharge hole diameter of the filaments subjected to the heat treatment and/or doubling and mixing the filaments and then carrying out drawing and heat treatment and/or false twisting.

BEST MODE FOR CARRYING OUT THE INVENTION

Figure 1:
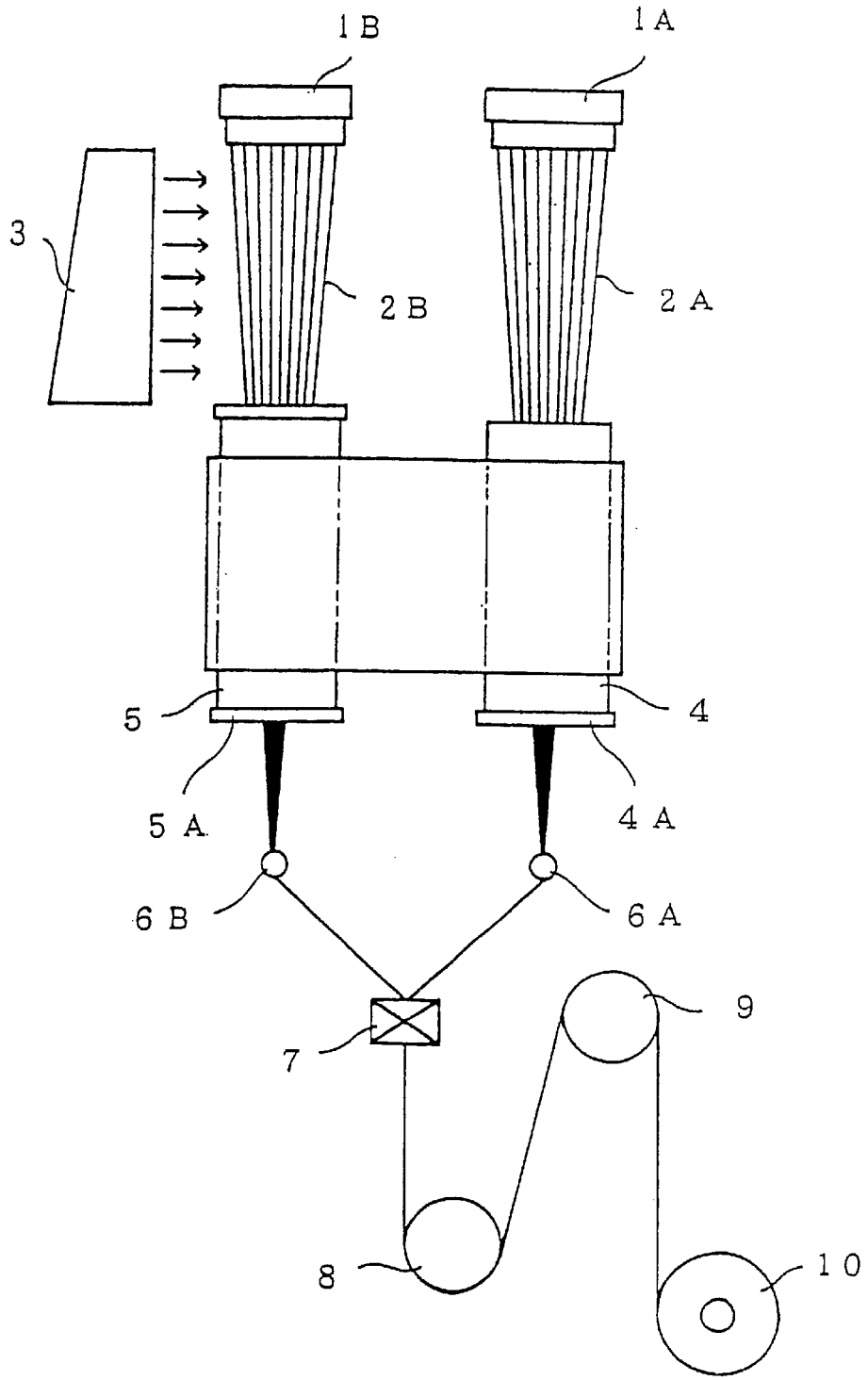
FIG. 1 is a schematic sketch diagram illustrating one example of an apparatus used for carrying out the present invention.

The mode for carrying out the present invention is explained in detail hereinafter.

The polyester component used in the present invention is a polyester comprising 85 mol % or more, preferably 95 mol % or more of ethylene terephthalate based on the whole recurring units; however, the polyester component may be a polyester copolymerized with a small amount (usually 20 mol % or below based on the terephthalic acid component) of a third component other than the terephthalic acid component and an ethylene glycol component. The intrinsic viscosity IV of the polyester (measured by using an o-chlorophenol solution at 35° C. according to a conventional method) is preferably within the range of 0.500 to 1.00 and especially preferably within the range of 0.550 to 0.700. A known additive, for example, a pigment, a dye, a delustering agent, an antisoiling agent, a fluorescent brightener, a flame retardant, a stabilizer, an ultraviolet absorber or a lubricant may be included in the polyester.

In the present invention, it is important to add a polymer different from the above polyester component (which may hereinafter simply be abbreviated to a polymer of a different kind) as a base polymer in an amount within the range of 0.5 to 5.0% by weight to the base polymer. That is, the orientation crystallinity of the melt-extruded filaments is suppressed to improve the extension characteristics by adding the polymer of the different kind in the present invention. For example, a polymethyl methacrylate-based polymer or a polystyrene-based polymer can be cited as the polymer of the different kind added for that purpose, and the polymethyl methacrylate-based polymer is especially preferred. Among them, a high-polymerization degree grade or a high-glass transition temperature grade reduces a tension load on the base polymer side not to make the orientation proceed, and the elongation of the resulting filaments is increased because a higher spinning tension than that of the base polymer is applied when the melt-extruded filaments are stretched, cooled and solidified.

When the amount of the added polymer of the different kind is too small, a sufficient elongation is hard to obtain, and it is difficult to achieve the object of the present invention. Conversely, when the amount is too high, not only effects on an increase in elongation are lowered but also stress concentration in the vicinity of the polymer of the different kind is produced to hardly cause uniform extension and deformation which result in spinning filament breakage, fineness unevenness, dyeing speck or the like. Thereby, the amount is preferably within the range of 0.5 to 5.0% by weight, especially within the range of 1.0 to 3.0% by weight.

Although the method for adding the polymer of the different kind to the base polymer is optional, a method for directly metering and adding the polymer of the different kind into a polymer transportation pipe on the base polymer side or a polymer charging inlet of an extruder is preferred. In addition, an injection method for melting the polymer of the different kind alone and injecting the molten polymer into the base polymer in a molten state can be carried out. Although the base polymer comprising the polymer of the different kind added thereto is melt kneaded and then extruded, both a single screw and a twin-screw extruders can be employed as the extruder used herein. The twin-screw extruder is preferably used in order to especially improve the kneadability. When the more uniform kneading is carried out, an extruder having a changed form of a screw channel such as Maddock type extruder is more preferred from the viewpoint of the kneadability.

A process as shown in FIG. 1 (schematic sketch diagram) can be cited as one example of the process of the present invention to which the method of production for obtaining the objective combined filament yarn from the above melt kneaded material is applied.

In FIG. 1, 1A indicates a spinneret for Group A; 1B indicates a spinneret for Group B; 2A indicates a multi-filament group (filament Group A); 2B indicates a multi-filament group (filament Group B); 3 indicates a spinning cooling apparatus; 4 indicates a cooking cylinder; 4A indicates an opening on the filament outlet side of the cooling cylinder; 5 indicates a non-contact type heat-treating cylinder; 5A indicates an opening on the filament outlet side of the heat-treating cylinder; 6A and 6B indicate oil applicators; 7 indicates an interlacing device; 8 and 9 indicate takeoff rollers; and 10 indicates a winder. In FIG. 1, an example of two spinning positions using two multi-filament yarns is explained; however, it is needless to say that, for example, equipment provided with three or more spinning positions may be used.

In the above process, the elongation of the finally resulting filaments is increased with increasing discharge hole diameter of the spinnerets 1A and 1B, though detailed reasons are unknown, in a system comprising the polymer of the different kind such as polymethyl methacrylate added to the base polymer. Thereby, the spinneret hole diameter on the side where heat treatment is not carried out is within the range of 1.5 times or above, preferably within the range of 2.0 to 5.0 times the spinneret hole diameter on the side where the heating treatment is conducted for improving the bulkiness or the like of the resulting combined filament yarn.

The polyester filament yarn Groups 2A and 2B respectively discharged from the spinnerets 1A and 1B are cooled and solidified with cooling air blown from the spinning cooling device 3 and then passed through the cooling cylinder 4 and the heat-treating cylinder 5. In the process, the filaments 2B are out of contact with the heat-treating cylinder 5, kept in an opened state and heat-treated in the heat-treating cylinder 5. A spinning oil is then applied to the filaments 2A and 2B subjected to the treatment with the oil applicators 6A and 6B, and the filaments 2A and 2B are then subjected to doubling and mixing of the filaments while being provided with tangling by the interlacing device 7, subsequently taken off by the takeoff rollers 8 and 9 and wound by the winder 10.

The cooling cylinder 4 is installed herein so as to keep the running filaments 2A from influences of the surrounding airflow when the filaments 2A run so that the running zone of the running filaments 2A is surrounded. The cooling cylinder 4 may be a simple cover herein; however, a structure for positively blowing cooling air may be used. An article of the same structure as that of the heat-treating cylinder 5 may directly be applied and used without heating.

In addition, the heat-treating cylinder 5 is preferably attached to a position below the spinneret at a distance of 0.5 to 1.5 m expressed in terms of the distance from the spinneret. For example, a cylindrical heat-treating cylinder having a length of 1.5 m and an inside diameter of 0.3 to 0.6 m and made of stainless steel is used as the shape of the heat-treating cylinder 5. A heating medium type heating device comprising a heating medium jacket surrounding the periphery of the heat-treating cylinder and sealing a heating medium therein is used as the heating means. Further, an electric heater may be used as another heating means; however, heating medium type heating is preferred from the viewpoint of the uniform heating and saving of energy consumption.

Furthermore, whenever the brands are changed over according to the differences such as the total fineness of the yarn or the single filament fineness of the respective filaments, optimum conditions can optionally be selected as the setting of the temperature of the heat-treating cylinder 5 (atmospheric temperature), if the temperature is about 300° C. or below. When the temperature becomes below about 120° C., the control of the atmospheric temperature, however, becomes difficult, and it is hard to carry out uniform drawing at a temperature in the vicinity of the glass transition temperature (Tg) of the polyester. In a low-temperature zone of the Tg or below, it is difficult to exhibit a difference in physical properties and a difference in crystal structure useful as a combined filament yarn. When the temperature exceeds 250° C., drawing is strongly carried out in the heat-treating cylinder 5. As a result, the substantial fineness on the upstream side of the heat-treating cylinder 5 is increased to thereby remarkably reduce the spinning tension near the inlet and cause yarn sway. Further, since the drawing is strongly conducted, the drawing tension in the heat-treating cylinder 5 is abnormally increased to cause problems that the filament breakage tends to occur. Thereby, the especially preferred set temperature range of the heat-treating cylinder 5 is 120 to 250° C., especially preferably 150 to 200° C.

When the opening of the opening 5A on the outlet side of the heat-treating cylinder 5 is enlarged, an air stream at a high temperature is discharged accompanying the filaments running at a high speed to the outside of the heat-treating cylinder 5. Therefore, the temperature in the heat-treating cylinder 5 is reduced from the glass transition temperature of the polyester, and the molecular orientation does not proceed. As a result, required mechanical characteristics are not obtained. In order to prevent the problems, the opening of the opening 5A on the outlet side is preferably constricted so as to provide a diameter of 0.5 to 10 mm, especially 3 to 8 mm. The opening 5A on the outlet side can be formed into an optional shape such as a circular, a square or a slit shape. Since the filaments running in the cooling cylinder 4 are kept in an unheated state, the opening of the opening 4A on the outlet side of the cooling cylinder is more preferably enlarged for exhibiting the difference in physical properties.

In the present invention, the takeoff speed of the filament groups at the takeoff rollers 8 and 9 shown in FIG. 1 must be 2500 m/min or above, preferably 3000 to 6500 m/min. When the takeoff speed is below 2500 m/min, any of the filament groups constituting the combined filament yarn are increased in elongation and boiling water shrinkage percentage. Thereby, the difference between the filament groups in elongation is reduced. Since the development of the difference in the physical properties is small even when the resulting combined filament yarn is further subjected to the so-called after processing such as drawing, heat treatment or false twist texturing. Characteristics such as softness or moire feeling (having a difference in light and shade of dyeing below 1 cm in the yarn longitudinal direction) are insufficient in aspects of color and color tone feeling. The combined filament yarn becomes a yarn having an ultra-low orientation unless the after processing is performed. Therefore, the combined filament yarn cannot be used as a woven or a knitted fabric at all. On the other hand, when the takeoff speed exceeds 6500 m/min, any filament groups are decreased in elongation and boiling water shrinkage percentage. As a result, the difference in the boiling water shrinkage percentage is reduced, and sufficient bulkiness is not obtained.

The takeoff rollers 8 and 9 may be heated or may not be heated. When the takeoff rollers are used as heating rollers herein, additional drawing or heat-setting can be performed while heating the filament groups between the heating rollers. Further, heating rollers can further be added to carry out relaxing treatment for relaxing the strain in the interior of the filaments in a spinning stage or false twist texturing of the resultant combined filament yarn can further be conducted.

The combined filament yarn obtained by the present invention exhibits a difference in physical properties and a difference in crystal structure among the respective multifilament yarns. As a result, excellent bulkiness and handle can be exhibited and even multicolor dyeing properties are provided in the yarn obtained by mixing the filaments. This is because the filament group in an unopened state passing through the heat-treating cylinder 5, subjected to drawing and heat-setting and stable in physical properties (which may hereinafter simply be abbreviated to Group A) has a higher degree of orientation ($\Delta n$) and specific gravity ($\rho$) than those of the filament group passing through the other cooling cylinder and taken off in an unheated state (which may hereinafter be abbreviated to Group B) and becomes low dyeable. Since the Group B reduced in elongation as opposed to an increase in strength is arranged in the center (core) thereof when converted into the combined filament yarn, the moire tone is readily exhibited.

In the present invention, elongation, degree of orientation, specific gravity, boiling water shrinkage percentage and the like of respective filaments depend on the amount of the added polymer of the different kind, spinning takeoff speed, set temperature of the heat-treating cylinder, temperature in the cooling cylinder, size of the opening on the outlet side of the heat-treating cylinder and the like; however, the values are nearly as follows:

Group A:

elongation: 40 to 380% (preferably 70 to 320%), degree of orientation: 0.010 to 0.120 (preferably 0.015 to 0.110), specific gravity: 1.320 or above and boiling water shrinkage percentage: 3 to 60% and Group B:

elongation: 25 to 180% (preferably 40 to 150%), degree of orientation: 0.030 to 0.150 (preferably 0.035 to 0.130), specific gravity: 1.335 or above (preferably 1.340 or above) and boiling water shrinkage percentage: 3 to 60%.

The difference between the Groups B and A in elongation is preferably 20% or above (preferably 25% or above) when the filaments are directly converted into a woven fabric or the like and the difference between the Groups A and B in elongation is preferably 50% or above (preferably 100% or above), the difference in orientation is preferably 0.02 or above, the difference in specific gravity is preferably 0.005 or above and the difference in boiling water shrinkage percentage is preferably 5% or above when drawing, heat treatment or false twist texturing is further carried out. Since the filament group of the Group A is essentially treated in an unheated state, the filament group has a structure close to that of raw silk and provides deeper dyed filaments as compared with the filament group of the Group B. The dyeing finish after mixing the filament groups assumes an appearance having a difference in light and shade dyeing.

Furthermore, in the present invention, the single filament fineness or the total fineness of the Groups A and B may be the same or different, and the cross-sectional shape may be the same or different. The change in fineness, however, results in respective mounting of gear pumps for metering the Groups A and B, respectively setting of the gear pumps to a prescribed number of revolutions, metering and feeding of the molten polyester and discharging of the metered and fed polyester from the spinnerets. Therefore, equipment capable of being set under the conditions is required, and the equipment cost is increased. As a result, the same fineness is generally frequently adopted. When the total fineness of the combined filament yarn is too large, a rough feeling is more produced than fullness. Conversely, when the total fineness is too small, the handle is felt hard. Thereby, the fineness is preferably within the range of 84 to 440 dtex, especially preferably within the range of 135 to 330 dtex expressed in terms of the total fineness (the total fineness after performing after processing such as false twist texturing when the after processing is carried out), and the single filament fineness is preferably 1.1 dtex to 3.3 dtex (the single filament fineness after carrying out the after processing such as false twist texturing when the after processing is performed).

The polyester combined filament yarn obtained by the present invention may directly be further used for weaving or the like; however, drawing, heat treatment or false twist texturing or the like, as necessary, may further be carried out in separate steps. Although the texturing ratio during the processing depends on the spinning takeoff speed or the like, the ratio is usually about 1.05 to 1.50 times. In the above description, an example of two spinning positions using two filament groups of the Groups B and A is explained; however, doubling and mixing of filaments may be carried out by changing heat-treating conditions or the like to provide a combined filament yarn even in, for example, three or more spinning positions.

The melting temperature and cooling conditions of the polyester may be conditions usually adopted for melt spinning of the polyester. Therefore, the polyester may be melted at a temperature within the range of, for example, 285 to 300° C. and cooled with cooling air at a temperature of 25° C. and a humidity of 65%. In the process, the filaments 2A in an opened state are usually passed through the cooling cylinder 4; however, a spinning oil may be once applied thereto on the upstream side of the cooling cylinder 4 with an oiling guide or the like, and the filaments 2A may be collected and passed through the interior of the cooling cylinder.

In the present invention, the heat-treating cylinder and the cooling cylinder may be installed in respective spinning positions; however, when the filament groups are passed through the plural heat-treating cylinders heated at the same set temperature with the same heating device and heat-treated, one filament group (Group B) in the opened state may be passed through the heat-treating cylinder and the other filament group (Group A) may be inserted into the heat-treating cylinder so as to be a non-contact state with the heat-treating cylinder and passed through the cooling cylinder in the unheated state in which the interior is cooled so as to provide the glass transition temperature of the base polymer or below.

The combined filament yarn having sufficient bulkiness due to the difference in heat shrinkage percentage and the difference in elongation and capable of exhibiting a moire feeling when doubling and mixing of the filaments are carried out can be obtained according to the above method.

Examples

The present invention is explained more specifically by citing Examples, which are not intended to limit the present invention. Respective values in the Examples are obtained by carrying out measurements according to the following methods:

Elongation

Measurement was made by using Autograph ["AGS-A-5K-NB (500-B)" manufactured by Shimadzu Corporation] under conditions of a sample length of 20 cm and a speed of testing rate of stretching of 100%/min according to the method described in JIS-1013 7-5-1.

Degree of orientation (Δn)

The degree of orientation was determined from the retardation obtained from a correction angle of a compensator under a monochromatic (sodium) lamp with a polarizing microscope, number of interference fringes and diameter of the sample according to a conventional method.

Boiling Water Shrinkage Percentage

The amount of shrinkage when heat-treating a sample in a restrained state in boiling water at 100° C. for 30 minutes was determined as percent based on the sample length before the heat treatment according to the method described in JIS L-1013 7-14-2.

Specific Gravity

Measurement was made by using an n-heptane:carbon tetrachloride mixture solution prepared so as to provide a specific gravity within the range of 1.276 to 1.416 according to the method described in JIS L-1013 7-15.

Handle

Five experts were randomly selected, and organoleptic tests were carried out on a woven fabric woven from the resulting combined filament yarn to make the relative comparison by touch. The criteria for the evaluation were indicated as ⊚: soft and rich in bulkiness, ○: somewhat soft, Δ: equal softness and X: hard as compared with a reference woven fabric woven from a false twist textured yarn of the same fineness having a strength of 1.8 to 2.4 g/d and an elongation of 18 to 25%. The color tone (moire tone) was evaluated as ⊚: clear moire with a difference in light and shade, ○: somewhat moire and X: thin moire without difference in light and shade by visual comparison.

Examples 1 to 4 and Comparative Examples 1 to 4

Chips of a polyethylene terephthalate composition prepared by adding 1.5% by weight of polymethyl methacrylate (hereinafter abbreviated to PMMA) based on the polyethylene terephthalate and having an intrinsic viscosity of 0.64 were respectively melted at a melting temperature of 290° C., melt-extruded from each of two kinds of spinnerets having a hole diameter of 0.2 mm ϕ, a land length of 0.8 mm and a number of holes of 36 and a number of holes of 48 using the spinneret with 36 holes on the side of filaments (Group B) for running through the interior of the heat-treating cylinder and the spinneret with 48 holes on the side of filaments (Group A) for running through the interior of the cooling cylinder, then once cooled with the spinning cooling device 3 which was the device shown in FIG. 1 and subsequently wound by changing the respective finenesses, spinning takeoff speeds, the set temperatures of the heating devices, compressed air flow rates for flowing in the cooling cylinder and the temperatures in the cooling cylinder as mentioned in Table 1. The heat-treating cylinder 5 was installed in a position at a distance of 1.0 m below the spinneret, and a cylindrical tube made of stainless steel having a length of 1.3 m and an inside diameter of 40 mm was used. In the process, a cylindrical tube having a length of 1.35 m and an inside diameter of 30 mm was used as the cooling cylinder 4. The opening on the outlet side of the heat-treating cylinder 5 was a circular opening having a diameter of 5 mm. The obtained results are as shown in Table 2.

The temperatures in the respective cylinders were measured by inserting temperature sensing elements (thermocouple elements) from the openings on the outlet sides of the heat-treating cylinder and the cooling cylinder and measured in positions at a distance of 300 mm above the opening on the outlet side of the heat-treating cylinder when the filaments were running. The handle and color tone were evaluated for textured yarns obtained by texturing the resulting combined filament yarns under conditions so as to provide a total fineness of 190 dtex after the false twist texturing in separate steps.

The combined filament yarns produced by the method of the present invention (Examples 1 to 4) had sufficient bulkiness and were good in handle and moire tone, and the combined filament yarns produced at a takeoff speed of especially 2500 to 3500 m/min were soft and good in bulkiness.

In contrast to this, the combined filament yarns produced at a spinning takeoff speed of 2000 m/min below 2500 m/min were felt bad at handle and moire tone due to the direction to conversely eliminate the difference in elongation (Comparative Example 1).

Furthermore, in the present invention, the temperature of the heat-treating cylinder must be necessarily and sufficiently raised to provide conditions so as to sufficiently draw the heated filaments (Group B), and, on the other hand, the temperature in the cooling cylinder must sufficiently be reduced to the glass transition temperature or below for the Group A. If the conditions are deficient, the combined filament yarns are unfavorable for handle. That is, since only the fiber orientation proceeds without carrying out heat-setting when the heat-treating conditions of the Group A, for example, the treating temperature is close to the glass transition point (Tg) region such as 90° C., the elongation shows a tendency to lower to about the same level as that of usually drawn filaments. The orientation, however, is raised and the specific gravity is extremely lowered. The handle becomes hard even at a high shrinkage percentage. Since the filaments are oriented in a cold drawing manner, the orientation distribution becomes nonuniform. Thereby, an irregular undrawn state is present. Even if the filaments were mixed in the state, a woven fabric having a too high shrinkage percentage was produced (Comparative Example 2).

When the heat-treating cylinder was not heated, no difference in physical properties of both the Groups A and B was caused, since they necessarily depended on the spinning speed (Comparative Example 3). Even when the temperature of the heat-treating cylinder was raised and set at 150° C. or above, only a uniform drawn yarn in which both the Groups A and B were drawn and heat-set was obtained as natural results unless the Group A was cooled. No difference in physical properties was caused, and a woven fabric unchanged in handle at all was obtained (Comparative Example 4).

The obtained results are shown in Table 1 and Table 2.

TABLE 1

| | Filament Group (A/B) | Raw Yarn Fineness (dtex) | Takeoff Speed (m/min) | Temperature in Heat-treating Cylinder/in Cooling Cylinder (° C.) |
|---|---|---|---|---|
| Example 1 | A | 160 | 2500 | 50 |
| | B | 160 | | 150 |
| Example 2 | A | 150 | 3500 | 50 |
| | B | 150 | | 180 |

TABLE 1-continued

| | Filament Group (A/B) | Raw Yarn Fineness (dtex) | Takeoff Speed (m/min) | Temperature in Heat-treating Cylinder/in Cooling Cylinder (° C.) |
|---|---|---|---|---|
| Example 3 | A | 122 | 4500 | 40 |
| | B | 122 | | 130 |
| Example 4 | A | 110 | 5000 | 60 |
| | B | 110 | | 150 |
| Comp. | A | 200 | 2000 | 50 |
| Example 1 | B | 200 | | 150 |
| Comp. | A | 145 | 3500 | 90 |
| Example 2 | B | 145 | | 180 |
| Comp. | A | 190 | 3500 | 50 |
| Example 3 | B | 190 | | 50 |
| Comp. | A | 145 | 3500 | 180 |
| Example 4 | B | 145 | | 180 |

Notes: Comp. Example means "Comparative Example".

TABLE 2

| | (1) | (2) (%) | (3) | (4) (g/cm$^3$) | (5) (%) | (6) | (7) |
|---|---|---|---|---|---|---|---|
| Example 1 | A | 300 | 0.0125 | 1.3250 | 48.5 | ⊙ | ○ |
| | B | 160 | 0.0380 | 1.3420 | 59.0 | | |
| Example 2 | A | 220 | 0.0167 | 1.3380 | 50.9 | ⊙ | ⊙ |
| | B | 120 | 0.0450 | 1.3453 | 58.3 | | |
| Example 3 | A | 135 | 0.0423 | 1.3442 | 60.2 | ○ | ⊙ |
| | B | 80 | 0.0896 | 1.3525 | 7.8 | | |
| Example 4 | A | 110 | 0.0496 | 1.3485 | 58.0 | ○ | ○ |
| | B | 70 | 0.1015 | 1.3633 | 5.4 | | |
| Comp. | A | 320 | 0.0119 | 1.3240 | 42.6 | Δ | X |
| Example 1 | B | 240 | 0.0143 | 1.3365 | 49.5 | | |
| Comp. | A | 150 | 0.0395 | 1.3320 | 61.2 | X | ○ |
| Example 2 | B | 120 | 00450 | 1.3395 | 58.3 | | |
| Comp. | A | 200 | 0.0222 | 1.3362 | 52.7 | X | X |
| Example 3 | B | 200 | 0.0222 | 1.3362 | 52.7 | | |
| Comp. | A | 120 | 0.0450 | 1.3250 | 58.3 | Δ | X |
| Example 4 | B | 120 | 0.0450 | 1.3250 | 58.3 | | |

Notes:
(1) Means "Filament Group".
(2) means "Elongation".
(3) means "Degree of Orientation".
(4) means "Density".
(5) means "Boiling Water Shrinkage Percentage".
(6) means "Handle".
(7) means "Color Tone (Moire Tone)".
Comp. Example means "Comparative Example".

Examples 5 to 9 and Comparative Example 5

Chips of a polyethylene terephthalate composition prepared by adding PMMA in an amount of 1.8% by weight based on the polyethylene terephthalate and having an intrinsic viscosity of 0.64 (with the proviso that chips of the polyethylene terephthalate without containing the PMMA were used in Comparative Example 5) were melted at a melting temperature of 295° C., melt-extruded from each of spinnerets with 36 holes for both the filament Groups A and B and a spinneret discharge hole diameter of 0.4 mm ϕ for the filament Group A and the same spinneret discharge hole diameter of 0.2 mm ϕ as that used in Example 1 for the filament Group B, then spun and subjected to filament mixing by using the same apparatus as that used in Example 1 except that the heating below the spinnerets was carried out so as to provide an atmospheric temperature of 250° C. in positions at a distance of 10 mm below the spinnerets (measured in positions at a distance of ±5 mm from the central position of the spinnerets) under conditions described in Table 3. The resulting combined filament yarns were directly converted into a woven fabric and evaluated. The obtained results are shown in Table 4.

The combined filament yarns produced by the method of the present invention (Examples 5 to 8) assumed a smooth touch due to a sufficient difference in elongation and a moire tone with light and shade was recognized in color tone. Excellent performances as compared with those of a conventional combined filament yarn prepared by spinning and filament mixing at about 6000 to 7000 m/min were exhibited. When the spinneret hole diameter ratio of the filament Group A and the filament Group B was increased, it was found that the difference in elongation was especially enlarged to exhibit softer handle.

In contrast to this, when the filaments were taken off at 5000 m/min without adding the PMMA, a woven fabric having a paperlike hard handle was merely obtained (Comparative Example 5). The obtained results are shown in Table 3 and Table 4.

TABLE 3

| | (1) (A/B) | (2) (dtex) | (3) (mm ϕ) | (4) (m/min) | (5) (° C.) |
|---|---|---|---|---|---|
| Example 5 | A | 61 | 0.40 | 5500 | 50 |
| | B | 61 | 0.20 | | 150 |
| Example 6 | A | 61 | 0.40 | 6000 | 50 |
| | B | 61 | 0.20 | | 150 |
| Example 7 | A | 61 | 0.40 | 7000 | 50 |
| | B | 61 | 0.20 | | 150 |
| Example 8 | A | 61 | 0.40 | 7500 | 50 |
| | B | 61 | 0.20 | | 150 |
| Example 9 | A | 61 | 0.30 | 6000 | 50 |
| | B | 61 | 0.20 | | 150 |
| Comp. | B | 61 | 0.20 | 5000 | 50 |
| Example 5 | B | 61 | 0.20 | | 150 |

Notes:
(1) means "Filament Group".
(2) means "Raw Yarn Fineness".
(3) means "Spinneret Hole Diameter".
(4) means "Takeoff Speed".
(5) means "Temperature in Heat-treating Cylinder/in Cooling Cylinder".
Comp. Example means "Comparative Example".

TABLE 4

| | (1) (A/B) | (2) (%) | (3) | (4) (g/cm$^3$) | (5) (%) | (6) | (7) |
|---|---|---|---|---|---|---|---|
| Example 5 | A | 80 | 0.0900 | 1.3545 | 5.4 | ○ | ⊙–○ |
| | B | 45 | 0.1115 | 1.3723 | 7.8 | | |
| Example 6 | A | 68 | 0.1025 | 1.3644 | 4.5 | ⊙ | ⊙ |
| | B | 40 | 0.1145 | 1.3745 | 8.0 | | |
| Example 7 | A | 52 | 0.1077 | 1.3696 | 4.3 | ⊙ | ⊙ |
| | B | 32 | 0.1225 | 1.3785 | 8.6 | | |
| Example 8 | A | 47 | 0.1105 | 1.3755 | 4.0 | ○ | ⊙–○ |
| | B | 26 | 0.1278 | 1.3792 | 8.3 | | |
| Example 9 | A | 62 | 0.1065 | 1.3687 | 4.3 | ⊙–○ | ⊙–○ |
| | B | 40 | 0.1145 | 1.3745 | 8.0 | | |
| Comp. | A | 75 | 0.1062 | 1.3678 | 3.5 | X | ○ |
| Example 5 | B | 39 | 0.1286 | 1.3789 | 6.0 | | |

Notes:
(1) means "Filament Group".
(2) means "Elongation".
(3) means "Degree of Orientation".
(4) means "Density".
(5) means "Boiling Water Shrinkage Percentage".
(6) means "Handle".
(7) means "Color Tone (Moire Tone)".
Comp. Example means "Comparative Example".

Possibility of Industrial Utilization

According to the method of the present invention, a polymer of a different kind is compounded in a polyester and one of the filament groups in an opened state is subjected to non-contact heat treatment and the other filament group is not substantially subjected to the heat treatment. Both the filament groups are simultaneously taken off at a speed of 2500 m/min or above and then doubled, and the filaments are mixed. Thereby, a combined filament yarn excellent in quality is stably and efficiently obtained, and a woven fabric assuming excellent bulkiness, moire tone, surface touch and the like is obtained from the combined filament yarn. The industrial value is extremely great.

What is claimed is:

1. A method for producing polyester-based combined filament yarn characterized as adding a polymer different from a base polymer comprising a polyester component in an amount within the range of 0.3 to 5.0% by weight based on the base polymer to the base polymer, melt-extruding the resulting composition from the same pack, cooling the extruded filament groups comprising polyester multi-filaments once to the glass transition temperature or below, then dividing the filament group into two groups, subjecting one of the filament groups in an opened state to non-contact heat treatment at an atmospheric temperature of 120° C. or above, keeping the other filament group in a state without being subjected to the heat treatment, subsequently simultaneously taking off the respective filament groups at a speed of 2500 m/min or above, doubling and mixing the filaments, wherein the spinneret hole diameter of the filament group without being subjected to the heat treatment is 1.5 times or above the spinneret hole diameter of the filament group in the opened state subjected to the heat treatment.

2. A method for producing polyester-based combined filament yarn as set forth in claim 1, wherein the drawing, heat treatment and/or false twist texturing are further carried out after doubling and mixing of the filaments.

* * * * *